United States Patent [19]

Chuang et al.

[11] 4,145,221

[45] Mar. 20, 1979

[54] SYNTHETIC POLYMER LATICES IN PHOTOGRAPHIC SILVER HALIDE EMULSIONS CONTAINING MULTIVALENT METAL SALTS

[75] Inventors: Jui-Chang Chuang, Vestal; Donald E. Trucker, Binghamton, both of N.Y.

[73] Assignee: GAF Corporation, New York, N.Y.

[21] Appl. No.: 849,652

[22] Filed: Nov. 8, 1977

[51] Int. Cl.[2] ..... G03C 1/72; G03C 1/38; G03C 1/06

[52] U.S. Cl. ..... 96/95; 96/108; 96/110; 96/114; 96/114.5

[58] Field of Search ..... 96/114, 114.5, 108, 96/95, 109, 111, 110

[56] References Cited

U.S. PATENT DOCUMENTS

| | | | |
|---|---|---|---|
| 3,178,295 | 4/1965 | Minsk et al. | 96/114 |
| 3,178,296 | 4/1965 | Minsk et al. | 96/114 |
| 3,325,286 | 6/1967 | Nottorf | 96/114 |
| 3,507,661 | 4/1970 | Ofstead | 96/114 |
| 3,508,925 | 4/1970 | Whiteley et al. | 96/108 |
| 3,623,878 | 11/1971 | Nishio et al. | 96/111 |
| 3,764,327 | 10/1973 | Nagae et al. | 96/114 |

*Primary Examiner*—Won H. Louie, Jr.

*Attorney, Agent, or Firm*—Walter C. Kehm; Edward G. Comrie

[57] ABSTRACT

Physical and photographic characteristics of silver halide emulsions containing salts of multivalent metals are improved by adding synthetic water-insoluble terpolymers of acrylic esters, glycidyl acrylates and acrylamides as emulsion additives. The crosslinkable terpolymers are highly compatible with silver halide emulsions containing multivalent metal salts when an acrylamide is a polymer component at less than 15 wt% and an anionic sulfate surfactant of the formula

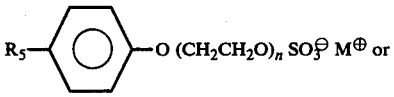

$R_5$—O $(CH_2CH_2O)_n$ $SO_3^{\ominus}$ $M^{\oplus}$ or $R_6$—O$(CH_2CH_2O)_n$ $SO_3^{\ominus}$ $M^{\oplus}$ where $R_5$ is a straight or branch-chain alkyl group of $C_4$–$C_{12}$, $R_6$ is a straight of branch-chain alkyl group of $C_8$–$C_{20}$, n is an integer of 8 to 40, and $M^+$ is an ammonium ion or, a monovalent metal ion such as potassium, sodium or cesium, is the dispersing agent during emulsion polymerization.

13 Claims, No Drawings

SYNTHETIC POLYMER LATICES IN PHOTOGRAPHIC SILVER HALIDE EMULSIONS CONTAINING MULTIVALENT METAL SALTS

FIELD OF THE INVENTION

This present invention relates to photographic gelatino silver halide emulsions containing multivalent metal salts and synthetic polymer latices. More particularly, this invention relates to the improvement in compatibility of synthetic polymer latices in photographic gelatino silver halide emulsions containing salts of multivalent metals. This invention also relates to the improvement in physical and photographic characteristics of lithographic films prepared from such emulsions.

BACKGROUND OF THE INVENTION

Salts of multivalent metals, such as cadmium chloride, zinc chloride, etc., are widely used as additives in lithographic gelatino silver halide emulsions to obtain better speed, gradient, aging stability and faster development rates. For practical applications, the light-sensitive photographic silver halide emulsion layers prepared from such emulsions must exhibit good physical characteristics such as dimensional stability, abrasion resistance and flexibility, especially when these emulsion layers are rapidly processed. Emulsion layer pick-off is a serious problem in rapid access processing in cases where the emulsion swells excessively. In the past, there had been several means proposed to reduce the swelling of gelatino silver halide emulsion layers. The swelling of the gelatino silver halide emulsion layer can be reduced, for example, by hardening gelatin by adding large amounts of hardeners such as formaldehyde and other crosslinking agents. This tends to produce detrimental changes on the physical and sensitometric characteristics of the emulsion layer, such as curling, high fog level, etc. In another approach, portions of gelatin were replaced with a water-insoluble, water-thinnable polymer dispersion, such as synthetic polymer latices of acrylic acid esters, and normal hardening agents added to improve dimensional stability, abrasion resistance and flexibility, such as described in U.S. Pat. Nos. 3,142,568 and 3,325,286. These synthetic polymer latices do not contain functional groups for further cross-linking reaction. This approach is limited to low level replacement of gelatin. When the replacement of gelatin with such synthetic polymer latices is above a certain level, the gain in swell reduction and flexibility is totally offset by the losses in abrasion resistance (wet scratch resistance) and transparency. This approach was improved upon by preparing synthetic polymer latices containing active functional groups such as aldehyde, epoxide, etc. for further crosslinking capability as described in U.S. Pat. Nos. 3,507,661 and 3,623,878. The emulsions described do not contain salts of multivalent metals such as cadmium chloride and zinc chloride which are known to cause instability of synthetic polymer latices.

The synthetic polymer latices of the prior art are prepared by conventional emulsion polymerization and stabilized by the absorption of anionic dispersing agents on the surface of latex particles. The electrostatic repulsion between anionic portions of the dispersing agent plays an important role with respect to the stability of the polymer latex. These anionic dispersing agents generally cannot tolerate large amounts of inorganic metal salts, especially salts of multivalent metals such as cadmium chloride, zinc chloride, etc. When the synthetic polymer latices are used to modify photographic gelatino silver halide emulsions containing multivalent metal salts, these synthetic polymer latices are destabilized by the multivalent metal ions and coagulate in the gelatino silver halide emulsions. This results in emulsion layers which are non-uniform and unsatisfactory for photography. In one instance, in order to reduce the coagulation of the synthetic polymer latex in the gelatino silver halide emulsion containing salts of multivalent metals, the gelatino polymer latex silver halide emulsion was coated onto a support and the protective layer containing multivalent metal salts was coated simultaneously to avoid the coagulation problem, such as described in U.S. Pat. No. 3,508,925.

SUMMARY OF THE INVENTION

It is an object of this invention to provide a class of synthetic polymer latices which can tolerate the presence of large amounts of salts of multivalent metals in the photographic silver halide emulsions.

Another object is to provide an admixture of finaled gelatino photographic silver halide emulsions containing salts of multivalent metals and synthetic polymer latices which is stable, does not coagulate and can be coated by conventional techniques.

A further object is to provide a photographic element with improved physical and sensitometric characteristics prepared from gelatino photographic silver halide emulsion containing salts of multivalent metals and synthetic polymer latices.

The present invention provides a class of synthetic polymer latices which improve the physical and sensitometric characteristics of a gelatino photographic silver halide emulsion which contain salts of multivalent metals. More particularly, the present invention provides a stable, coagulation-free gelatino photographic silver halide emulsion containing salts of multivalent metals modified by adding a class of synthetic polymer latices to the emulsion and photographic products prepared therefrom. The synthetic polymer latices are a class of terpolymers of alkyl acrylates, glycidyl acrylates and acrylamides. The synthetic polymer latices improve the physical characteristics such as swell reduction, coating uniformity and wet scratch resistance, etc., of a gelatino photographic silver halide emulsion containing salts of multivalent metals as well as sensitometric characteristics such as fog reduction. The stability of the synthetic polymer latex employed in the gelatino photographic silver halide emulsion is due to incorporating acrylamide as a component of the terpolymer and selecting a surfactant insensitive to salts of multivalent metals. Surfactants of the alkyloxypoly(oxyethylene)sulfate or alkylphenoxypoly(oxyethylene)sulfate type are particularly suitable as dispersing agents. In the coated photographic light-sensitive layers, the synthetic polymer latex is part of the binder and ensures the processibility of such layers under relatively harsh conditions.

According to this invention, the synthetic polymer latices are water-insoluble latex polymers, which do not coagulate in gelatino photographic silver halide emulsions containing salts of multivalent metals, and which form continuous, transparent layers after drying at a temperature above 20° C.

Typical synthetic polymer latices particularly suited for use in the present invention are acrylic terpolymers containing active epoxide and amide functional groups.

These acrylic terpolymers contain 40–90% of an acrylate of the structure:

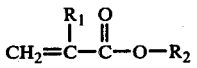

where $R_1$ is hydrogen or methyl and $R_2$ is a straight or branched-chain alkyl group of $C_1$ to $C_8$; 5–50% of a glycidyl acrylate of the structure:

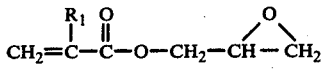

where $R_1$ is hydrogen or methyl and 1–20% of an acrylamide monomer of the structure:

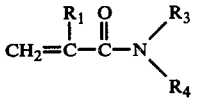

where $R_1$ is hydrogen or methyl, $R_3$ is hydrogen or a straight or branch-chain alkyl group of $C_1$ to $C_8$ and $R_4$ is hydrogen, a straight- or branch-chain alkyl group of $C_1$ to $C_8$, an aryl group, a methylol group, an isobutoxymethyl group, a 1,1-dimethyl-3-oxobutyl group, a hydroxymethylated 1,1-dimethyl-3-oxobutyl group and the like. In addition to the presence of glycidyl methacrylate or glycidyl acrylate as a component of the polymer latices for further crosslinking capability, these synthetic polymer latices exhibit excellent compatibility with salts of multivalent metals as well as excellent storage stability, due to the presence of an acrylamide as a component of the terpolymer latices. The preferred synthetic polymer latices of this invention are poly(ethyl acrylate/glycidyl methacrylate/acrylamide), poly(n-butyl acrylate/glycidyl methacrylate/acrylamide), poly(ethyl acrylate/glycidyl methacrylate/N-methylolacrylamide), poly(ethyl acrylate/glycidyl methacrylate/methacrylamide), poly(ethyl acrylate/glycidyl methacrylate/diacetone acrylamide), poly(ethylacrylate/glycidyl methacrylate/N-hydroxymethylated diacetone acrylamide), poly(ethyl acrylate/glycidyl methacrylate/N-isobutoxymethylacrylamide) and the like. The most preferred terpolymer latex is poly(ethyl acrylate/glycidyl methacrylate/acrylamide).

The acrylic terpolymers are polymerized in the presence of a dispersing agent such as an alkylphenoxypoly(oxyethylene)sulfate or an alkyloxypoly(oxyethylene)sulfate of the structures:

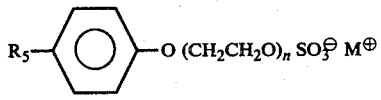

$R_6$—O $(CH_2CH_2O)_n$ $SO_3^{\ominus}$ $M^{\oplus}$ where $R_5$ is a straight- or branch-chain alkyl group of $C_4$ to $C_{12}$, $R_6$ is a straight- or branch-chain alkyl group of $C_8$ to $C_{20}$, n is an integer of 8 to 40 and M is an ammonium ion, or a monovalent metal ion such as sodium, potassium, cesium or the like. The preferred dispersing agent is ammonium nonylphenoxypoly(oxyethylene)$_9$ sulfate (i.e. $R_5$=$C_9H_{19}$, n=9 and $M^{\oplus}$ = $NH_4^{\oplus}$). The anionic dispersing agent with longer poly(oxyethylene) chain length tends to be more non-ionic in character and shows high tolerance to the salts of multivalent metals, compared to the anionic dispersing agents described in U.S. Pat. No. 3,325,286 ($R_5$=t=$C_8H_{17}$, n=2–6, and $M^{\oplus}$ = $Na^{\oplus}$). The addition of synthetic polymer latices of this invention, which contain dispersing agents of this type to a gelatino photographic silver halide emulsion containing multivalent metal salts does not impair the photographic quality of coatings prepared therefrom. The dispersing agent is used in an amount of from 0.1 to 10% and preferably from 2 to 6% by weight of the polymer solids.

The salts of multivalent metals which can be used to improve the photographic properties of gelatino silver halide emulsions are metal salts of cadmium, magnesium, zinc, rhodium, platium and iridium. Typical examples are cadmium chloride, cadmium nitrate, magnesium chloride, zinc nitrate, zinc chloride, and rhodium trichloride.

The synthetic polymer latices of the present invention can be used as photographic emulsion additives and mixed directly with a finaled gelatino photographic silver halide emulsion containing salts of multivalent metals prior to coating. The finaled photographic silver halide emulsion can be coated on a support by conventional coating techniques. In a preferred embodiment, a gelatino photographic silver halide emulsion containing salts of multivalent metals is finaled with sensitizing dyes, anti-foggants, stabilizers, speed regulators, coating aids and hardening agents and the synthetic polymer latices are then added. The synthetic polymer latices of the present invention are stable and free of coagulation in the finaled photographic silver halide emulsion containing multivalent metal salts after holding at coating temperature (38° C.) for more than 12 hours. The photographic light-sensitive layers coated from such finaled silver halide emulsions also give stable sensitometric readings after said holdings.

The following examples are given by way of illustration and not of limitation. Unless otherwise indicated all parts, percents, ratios and the like are by weight.

EXAMPLE 1

Preparation of Polymer I:

Ethyl acrylate/glycidyl methacrylate (78/22) copolymer Latex

Into a 4-necked, 3-liter flask heated by a steam bath and equipped with a mechanical stirrer, a reflux condenser, a nitrogen inlet tube, and a thermometer was charged:

- 390 g of ethyl acrylate
- 110 g of glycidyl methacrylate
- 50 g of dispersing agent AT670 (ammonium nonylphenoxy poly(oxyethylene)$_4$ sulfate, 60% active; GAF Corp., Chemical Division), 6% based on weight of monomers.
- 1400 g of deaerated, deionized water The reactor contents were gently purged with prepurified nitrogen for 60 minutes while the reaction mixture was emulsified at 25° C. (300 rpm). The nitrogen flow was then reduced to a low rate over the surface and the following redox initiator was added:

- 1.00 g of potassium persulfate ($K_2S_2O_8$) in 50 ml of deionized water
- 0.040 g of ferrous ammonium sulfate $Fe(NH_4)_2(SO_4)_2\ 6H_2O$ in 20 ml of deionized water
- 0.50g of potassium metabisulfite ($K_2S_2O_5$) in 50 ml of deionized water The reaction mixture was heated over a steam bath at a rate of 1° C. per minute to 37° C. Heating was stopped at this point, because a rapid exothermic reaction occured. The internal temperature reached a maximum of 78° C. within 8 minutes. The polymer latex thus prepared was stirred for an additional 30 minutes with no further heating, then cooled to 25° C. and bottled.

Preparation of Polymers II-IV:

Ethyl acrylate/glycidyl methacrylate (78/22) copolymer latices.

The procedure for the preparation of ethyl acrylate/-glycidyl methacrylate (78/22) copolymer latices II-IV was identical to the procedure described in the preparation of Polymer I except different amounts or/and classes of the dispersing agents were used in each preparation.

EXAMPLE 2

Polymer II:

33.3 g of dispersing agent AT670 (ammonium nonylphenoxypoly(oxyethylene)$_4$ sulfate, 60% active; GAF Corporation, Chemical Division), 4% based on weight of monomers.

EXAMPLE 3

Polymer III:

33.3 g of dispersing agent At660 (ammonium nonylphenoxypoly(oxyethylene)$_9$ sulfate, 60% active; GAF Corporation, Chemical Division), 4% based on weight of monomers.

EXAMPLE 4

Polymer IV:

50 g of dispersing agent AT660 (ammonium nonylphenoxypoly(oxyethylene)$_9$ sulfate, 60% active; GAF Corporation, Chemical Division), 6% based on weight of monomers.

EXAMPLE 5

Preparation of Polymer V:

Ethyl acrylate/glycidyl methacrylate/acrylamide (70/25/5) Terpolymer latex.

Into a 3-liter, 4-necked flask heated by a steam bath and equipped with a mechanical stirrer, a reflux condenser, a nitrogen inlet tube and a thermometer was placed a mixture of:

- 350 g of ethyl acrylate
- 125 g of glycidyl methacrylate
- 25 g of acrylamide
- 33.3 g of dispersing agent AT660 (60% active), 4% based on weight of monomers.
- 1400 g of deaerated, deionized water The reactor contents were purged with pre-purified nitrogen for 60 minutes while the reaction mixture was emulsified at 25° C. (300 rpm). The nitrogen flow was then reduced to a low rate over the surface and the following redox initiator was added:

- 1.00 g of potassium persulfate ($K_2S_2O_8$) in 50 ml of deionized water
- 0.040 g of ferrous ammonium sulfate $Fe(NH_4)_2(SO_4)_2\ 6H_2O$ in 15 ml of deionized water
- 0.50 g of potassium metabisulfite ($K_2S_2O_5$) in 50 ml of deionized water The reaction mixture was heated gently over the steam bath at a rate of 1° C. per minute to 35° C. Heating was stopped at this stage, and a rapid exothermic polymerization occurred. The internal temperature reached a peak of 79° C. within 10 minutes. The polymer latex thus prepared was stirred for an additional 30 minutes with no further heating, then cooled to 25° C. and bottled.

Preparation of Polymers VI-XI:

Ethyl acrylate/glycidyl methacrylate/acrylamide (70/25/5) Terpolymer latices.

The procedure for the preparation of ethyl acrylate/-glycidyl methacrylate/acrylamide (70/25/5) terpolymer latices VI–XI was identical to the procedure described in the preparation of Polymer V except different amounts or/and classes of the dispersing agents were used in each preparation.

EXAMPLE 6

Polymer VI:

50.0 g of dispersing agent AT670 (60% active), 6% based on weight of monomers.

EXAMPLE 7

Polymer VII:

20.0 g of dispersing agent Aerosol OT® (sodium dioctyl sulfosuccinate, 75% active; American Cyanamid Company), 3% based on weight of monomers.

EXAMPLE 8

Polymer VII:

20.0 g of dispersing agent SDS (sodium dodecyl sulfate, 100% active; K & K Labs), 4% based on weight of monomers.

EXAMPLE 9

Polymer IX:

33.3 g of dispersing agent AT701 (ammonium docecyloxypoly(oxyethylene)$_{11}$ sulfate, 60% active; GAF Corporation, Chemical Division), 4% based on weight of monomers.

EXAMPLE 10

Polymer X:

80.0 g of dispering agent Triton X-770® (sodium t-octylphenoxypoly(oxyethylene)$_n$ sulfate, 25% active; Rohm & Haas Co.), 4% based on weight of monomers.

EXAMPLE 11

Polymer XI:

71.4 g of dispersing agent Triton X-200® (sodium t-octylphenoxypoly(oxyethylene)$_3$ sulfonate, 28% active; Rohm & Haas Co.), 4% based on weight of monomers.

Preparation of Polymers XII-XV:

Ethyl acrylate/glycidyl methacrylate/acrylamides (70/25/5) terpolymer latices.

The procedure for the preparation of ethyl acrylate/-glycidyl methacrylate/acrylamides (70/25/5) terpolymer latices XII-XV was identical to the procedure described in the Preparation of Polymer V except different acrylamides were used in each preparation. The term acrylamides as used herein denotes the acrylamide monomer and its 2- and N-substituted acrylamides such as methacrylamide, N-methylolacrylamide, hydroxymethylated diacetone acrylamide, N-(isobutoxymethyl) acrylamide. The amounts of ethyl acrylate and glycidyl methacrylate are 350 g and 125 g respectively in each of the examples.

EXAMPLE 12

Polymer XII:

25 g of methacrylamide.

EXAMPLE 13

Polymer XII:

41.7 g of N-methylolacrylamide (60% aqueous solution)

EXAMPLE 14

Polymer XIV:

45.5 g of hydroxymethylated diacetone acrylamide (55% aqueous solution)

EXAMPLE 15

Polymer XV:

29.4 g of N-(iso-butoxymethyl)acrylamide (85% active)

The compatibility of synthetic polymer latices with salts of multivalent metals was evaluated by adding 10% cadmium chloride or 10% magnesium chloride to 10 ml of a 10% polymer latex up to 5 ml. When the polymer latex is incompatible with the multivalent metal salts, the polymer latex usually coagulates instantaneously or coagulates within a few hours after adding full amounts of the multivalent metal salt. On the other hand, when the polymer latex is compatible with the multivalent metal salt, the polymer latex is free of coagulation for a few days after adding full amounts of the multivalent metal salt. According to this test method, the compatibility of synthetic polymer latices I–XV with multivalent metal salts ($CdCl_2$ and $MgCl_2$) is rated arbitrarily as:

A: The polymer latex is free of coagulation for more than three days at 25° C.

B: The polymer latex coagulates within three days at 25° C.

C: The polymer latex coagulates within four hours at 25° C.

D: The polymer latex coagulates instantaneously at 25° C.

The amounts of 10% $CdCl_2$ or 10% $MgCl_2$ used in the ratings A, B and C are 5 ml per 10 ml of 10% polymer latex. In rating D, only 0.10 ml of 10% $CdCl_2$ or 10% $MgCl_2$ is added into 10 ml of 10% polymer latex. The testing results are summarized in Table I.

TABLE I

Compatibility of the Synthetic Polymer Latices With $CdCl_2$ and $MgCl_2$

| Polymer | Polymer Composition (1) | Wt. % of Surfactant (2) | POE Chain Length (3) | $CdCl_2$ | $MgCl_2$ |
|---|---|---|---|---|---|
| I | EA/GM (78/22) | 6% AT670 | 4 | A | C |
| II | EA/GM (78/22) | 4% AT670 | 4 | A | D |
| III | EA/GM (78/22) | 4% AT660 | 9 | A | D |
| IV | EA/GM (78/22) | 6% AT660 | 9 | A | B |
| V | EA/GM/AM (70/25/5) | 4% AT660 | 9 | A | B |
| VI | EA/GM/AM (70/25/5) | 6% AT670 | 4 | A | C |
| VII | EA/GM/AM (70/25/5) | 3% Aerosol OT® | 0 | D | D |
| VIII | EA/GM/AM (70/25/5) | 4% SDS | 0 | D | D |
| IX | EA/GM/AM (70/25/5) | 4% AT701 | 11 | A | A |
| X | EA/GM/AM (70/25/5) | 4% Triton X-770® | | B | D |
| XI | EA/GM/AM (70/25/5) | 4% Triton X-200® | 3 | B | B |
| XII | EA/GM/MAM (70/25/5) | 4% AT660 | 9 | B | D |
| XIII | EA/GM/NMA (70/25/5) | 4% AT660 | 9 | A | B |
| XIV | EA/GM/HMDAA (70/25/5) | 4% AT660 | 9 | A | A |
| XV | EA/GM/IBMA (70/25/5) | 4% AT660 | 9 | A | A |

NOTES:

(1) Monomers: EA (ethyl acrylate), GM (glycidyl methacrylate), AM (acrylamide), MAM (methacrylamide), NMA (N-methylolacrylamide), HMDAA (hydroxymethylated diacetone acrylamide) and IBMA (N-isobutoxymethyl-acrylamide).

(2) Active agent based on weight of monomers. See polymer preparation section for surfactant structure.

(3) Poly(oxyethylene), (POE) chain length of the surfactant.

The testing results of Polymers I–IV indicate that polymer latices prepared with increasing poly(oxyethylene) chain length dispersing agents are progressively less sensitive to salts of multivalent metals. Evaluation of Polymers V–IX also indicates similar results. The most incompatible polymer latices are those prepared from dispersing agent having no poly(oxyethylene) chain, such as Aerosol OT® and sodium dodecylsulfate. Evaluation of Polymers XII–XV has indicated that the acrylamide in Polymers V–XI can be replaced by other 2- and N-substituted acrylamides to achieve excellent multivalent metal salt compatibility.

The compatibility of synthetic polymer latices with typical gelatino silver halide emulsion containing salts of multivalent metals was then tested. 1200 g of a fine grain gelatino lithographic silver halide emulsion containing $CdCl_2$ was split into four equal parts and each was finaled with sensitizing dyes, anti-foggants, stabilizers, coating aids, speed regulators and hardening agents. To each emulsion was added 45 ml of polymer latex I, III, V and VI, respectively so that the polymer latex-gelatin ratio in the photographic binder was 40:60. The weight ratio of cadmium chloride to silver halide in the photographic emulsion was 4.9:100. The finaled emulsions were held in a 38° C. constant temperature water bath for a period up to 24 hours. A thin layer of each emulsion was coated on a glass slide at different time intervals and examined under a 14× magnification lens. The holding stability of the polymer latex in the photographic emulsion, based on the time needed to detect the coagulation of the polymer latex, is summarized as follows:

| Polymer | Polymer Composition | Wt% of Surfactant | POE Chain Length | Holding Stability |
|---|---|---|---|---|
| I | EA/GM (78/22) | 6% AT670 | 4 | 5 hrs. |
| III | EA/GM (78/22) | 4% AT660 | 9 | >12 hrs. |
| IV | EA/GM/AM (70/25/5) | 6% AT670 | 4 | 7 hrs. |
| V | EA/GM/AM (70/25/5) | 4% AT660 | 9 | >12 hrs. |

The results clearly indicate that the stability of the polymer latices in the presence of salts of multivalent metals (such as $CdCl_2$) can be improved by selecting a dispersing agent with long poly(oxyethylene) (POE) chain length in polymer latices synthesis. The stability of the polymer latices in the presence of salts of multivalent metals can be further improved by incorporating of acrylamide or its -or N-substituted derivative as a polymer component.

Evaluation Of Coatings From a Gelatino Silver Halide Emulsion Containing Salts of Multivalent Metals and Synthetic Polymer Latices 300 g of a fine-grain gelatino lithographic silver halide emulsion containing $CdCl_2$ was finaled with sensitizing dyes, anti-foggants, stabilizers, coating aids, speed regulators and hardening agents. Approximately 45 ml of the polymer latex was then added so that the polymer latex-gelatin ratio in the photographic binder was 40:60. The weight ratio of cadmium chloride to silver halide in the photographic emulsion was 4.9:100. The finaled emulsions were held in 38° C. constant temperature water bath for a period of 3.5–5.5 hours prior to the coating. The finaled emulsions were coated on a polyester support with a green non-curling layer on the backside. The ethyl acrylate/glycidyl methacrylate/acrylamide (70/25/5) terpolymer latex with sodium dodecylsulfate as dispersing agent coagulated in the gelatino silver halide emulsion containing $CdCl_2$. The polymer latices listed in Table II showed good holding stability for the period indicated. The coated emulsion layers were evaluated for fog level, % haze and swell reduction, using 100% gelatin binder as control.

amount, by weight, based on the weight of polymer solids of from 0.5 to 10%.

2. Gelatino silver halide photographic emulsions of claim 1 wherein the gelatin to polymer latex ratios are from 20:80 to 95:5.

3. Gelatino silver halide photographic emulsions as set forth in claim 1 wherein the terpolymer latex contains an anionic sulfate-type surfactant, in an amount from 2 to 6% based on the weight of polymer solids.

4. Gelatino silver halide photographic emulsions as set forth in claim 1 wherein the acrylate portion of the terpolymer has the structure:

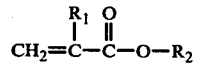

wherein $R_1$ is hydrogen or methyl and $R_2$ is a straight- or branch-chain alkyl group having 1–8 carbon atoms, the glycidyl acrylate portion has the structure:

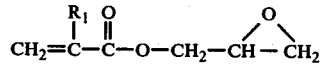

where $R_1$ is hydrogen or methyl and the acrylamide portion has the structure:

TABLE II

| Polymer | Wt % of Surfactant | Evaluation of Synthetic Polymer Latex in Photographic Emulsion Coatings: % Gardner Haze, Fresh Fixed-Out Strips (1) | % Gardner Haze, Forced Fog Strips (2) | Fog 3' GAFMATE Developer) (3) | Fog (15" Kodak 55 Processing® 40° Developer (4) | Forced Fog (5' Liquid Contact Developer (6) | % Swell |
|---|---|---|---|---|---|---|---|
| Gelatin | — | 4.5 | 22.2 | 0.04 | 0.12 | 0.17 | 150 |
| I | 6% AT670 | 8.2 | 27.1 | 0.07 | 0.09 | 0.26 | 105 |
| II | 4% AT670 | 4.5 | 18.1 | 0.04 | 0.10 | 0.13 | 110 |
| III | 4% AT660 | 12.4 | 28.3 | 0.05 | 0.10 | 0.13 | 100 |
| V | 4% AT660 | 6.6 | 19.3 | 0.04 | 0.07 | 0.11 | 90 |
| IX | 4% AT701 | 7.1 | 21.6 | 0.04 | 0.10 | 0.13 | 130 |
| X | 4% Triton X-770® | 4.3 | 17.6 | 0.04 | 0.10 | 0.13 | 130 |
| XI | 4% Triton X-200® | 5.3 | 18.0 | 0.04 | 0.10 | 0.13 | 120 |
| XII | 4% AT660 | 4.2 | 16.7 | 0.04 | 1.10 | 0.13 | 125 |
| XIII | 4% AT660 | 6.6 | 19.2 | 0.04 | 0.09 | 0.11 | 110 |
| XIV | 4% AT660 | 4.3 | 17.8 | 0.04 | 0.10 | 0.12 | 140 |
| XV | 4% AT660 | 4.6 | 16.7 | 0.04 | 0.10 | 0.13 | 130 |

NOTES:
(1) % haze (ASTM value) was measured on a Gardner Hazemeter. Strips of the emulsion coatings were fixed out in red light. The haze value is due to film base and binder.
(2) % haze for forced fog processed strips is due to haze of binder, Ag° and film base.
(3)' GAFMATE® developer is a manual process at 20° C. which approximates the sensitometry of a high temperature automatic processor.
(4) The 15 second KodaK 55 Process® is carried out at 40° C. and involves the use of rubber squeegee rollers for tranport.
(5) Forced fog developer is a liquid contact type which will promote maximum expected fog from a strip sample.

The results have indicated that ethyl acrylate/glycidyl methacrylate/acrylamide (70/25/5) and ethyl acrylate/glycidyl methacrylate/acrylamides (70/25/5) are superior to ethyl acrylate/glycidyl methacrylate (78/22) copolymer for haze reduction and fog reduction.

While the invention has been described in detail with respect to specific embodiments thereof, it will be apparent to one skilled in the art that various changes and modifications can be made therein without departing from the spirit and scope thereof.

What is claimed is:

1. Gelatino silver halide photographic emulsions containing salts of multivalent metal in which the gelatin is partially replaced by a terpolymer latex consisting of, by weight, 40–90% acrylates, 5–50% glycidyl acrylates and 1–20% acrylamides and where in the terpolymer latex contains an anionic sulfate-type surfactant in an

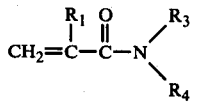

wherein $R_1$ is hydrogen or methyl, $R_3$ is hydrogen or a straight- or branch-chain alkyl group having 1–8 carbon atoms, $R_4$ is hydrogen, a straight or branch-chain alkyl group having 1–8 carbon atoms, an aryl group, a methylol group, an isobutoxymethyl group, a 1,1-dimethyl-3-oxybutyl group, or a hydroxymethylated 1,1-dimethyl-3-oxybutyl group.

5. Gelatino silver halide photographic emulsions as set forth in claim 4 wherein the latex particles range in average diameter from 0.01 to 1.0 mm and have a glass transition temperature of below about 20° C.

6. Gelatino silver halide photographic emulsions as set forth in claim 4 wherein the anionic sulfate-type dispersing agent for the polymer latex is an alkylphenoxypoly(oxyethylene)sulfate or an alkyloxypoly(oxyethylene)sulfate of the structures:

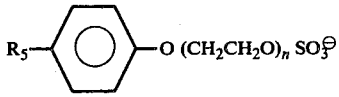

$R_6—O\ (CH_2CH_2O)_n\ SO_3^{\ominus}\ M^{\oplus}$ wherein $R_5$ is a straight- or branched-chain alkyl group of 4–12 carbon atoms, $R_6$ is a straight- or branched-chain alkyl group of 8–20 carbon atoms, n is an integer of 8–40, $M^{\oplus}$ is an ammonium ion or a monovalent ion selected from the group consisting of sodium, potassium or cesium.

7. Gelatino silver halide photographic emulsions as set forth in claim 6 wherein the anionic sulphate-type dispersing agent for the polymer latex is selected from the group consisting of ammonium nonylphenoxypoly(oxyethylene)$_9$ sulfate and ammonium nonylphenoxypoly(oxyethylene)$_{30}$ sulfate, and ammonium dodecyloxypoly(oxyethylene)$_{11}$ sulfate.

8. A photographic element comprising a photographically acceptable support having on at least one surface thereof a gelatino silver halide photographic emulsion containing salts of multivalent metals in which the gelatin is partially replaced by a terpolymer consisting of, by weight, 40–90% acrylates, 5–50% glycidyl acrylates and 1–20% acrylamides and wherein the terpolymer latex contains an anionic sulfate-type surfactant in an amount, by weight, based on the weight of polymer solids from 0.5 to 10%.

9. A photographic element as set forth in claim 8 wherein the gelatin to terpolymer latex ratios are from 20:80 to 95:5.

10. A photographic element as set forth in claim 8 wherein the terpolymer latex contains an anionic sulfate-type surfactant in an amount of from 2–6% by weight based on the weight of polymer solids.

11. A photographic element as set forth in claim 8 wherein the acrylate portion of the terpolymer has the structure:

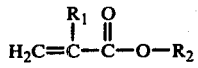

wherein $R_1$ is hydrogen or methyl and $R_2$ is a straight or branch-chain alkyl group having 1–8 carbon atoms, the glycidyl acrylate portion has the structure:

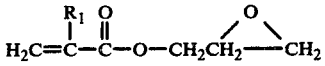

where $R_1$ is hydrogen or methyl and the acrylamide portion has the structure:

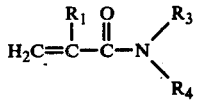

wherein $R_1$ is hydrogen or methyl, $R_3$ is hydrogen or a straight- or branch-chain alkyl group having 1–8 carbon atoms, $R_4$ is hydrogen, a straight or branch-chain alkyl group having 1–8 carbon atoms, an aryl group, a methylol group, an isobutoxymethyl group, a 1,1-dimethyl-3-oxybutyl group, or a hydroxymethylated 1,1-dimethyl-3-oxybutyl group.

12. A photographic element as set forth in claim 10 wherein the latex particles range in diameter from 0.01 to 1.0 um, and having a glass transition temperature below about 20° C.

13. A photographic element as set forth in claim 11 wherein the anionic sulfate-type dispersing agent is an alkyl phenoxypoly(oxyethylene)sulfate or an alkyloxypoly(oxyethylene) sulfate of the structures:

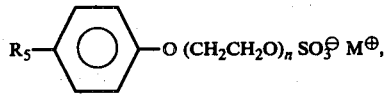

$R_6—O\ (CH_2CH_2O)_n\ SO_3^{\ominus}\ M^{\oplus}$ wherein $R_5$ is a straight or branch-chain alkyl group of 4–12 carbon atoms, $R_6$ is a straight- or branch-chain alkyl group of 8–20 carbon atoms, n is an integer of 8–40, and $M^{\oplus}$ is an ammonium ion or a monovalent ion selected from the group consisting of sodium, potassium or cesium.

* * * * *